US009146076B2

(12) United States Patent
Jung et al.

(10) Patent No.: US 9,146,076 B2
(45) Date of Patent: Sep. 29, 2015

(54) DOT SIGHT DEVICE HAVING POWER SAVING FUNCTIONS, THE CONTROL METHOD THEREOF

(71) Applicants: In Jung, Bucheon-si, Gyeonggi-do (KR); Bo Sun Jeung, Bucheon-si, Gyeonggi-do (KR)

(72) Inventors: In Jung, Bucheon-si (KR); Bo Sun Jeung, Bucheon-si (KR); Tae Soo Shin, Gwangmyeong-si (KR); Dong Hee Lee, Seongnam-si (KR)

(73) Assignees: In Jung, Gyeonggi-do (KR); Bo Sun Jeung, Gyeonggi-do (KR)

( * ) Notice: Subject to any disclaimer, the term of this patent is extended or adjusted under 35 U.S.C. 154(b) by 60 days.

(21) Appl. No.: 13/761,941

(22) Filed: Feb. 7, 2013

(65) Prior Publication Data

US 2013/0199073 A1 Aug. 8, 2013

(30) Foreign Application Priority Data

Feb. 8, 2012 (KR) ..... 10-2012-0012841
Feb. 1, 2013 (KR) ..... 10-2013-0011820

(51) Int. Cl.
*F41G 1/00* (2006.01)
*F41G 1/30* (2006.01)

(52) U.S. Cl.
CPC ... *F41G 1/00* (2013.01); *F41G 1/30* (2013.01)

(58) Field of Classification Search
CPC ..... F41G 1/00; F41G 1/30
USPC ..... 42/113–117, 122, 130
See application file for complete search history.

(56) References Cited

U.S. PATENT DOCUMENTS

2005/0155270 A1* 7/2005 Snyder ..... 42/114

FOREIGN PATENT DOCUMENTS

JP 2008-501932 A 1/2008
KR 20-1999-0034107 8/1999
KR 10-0669859 B1 1/2007

OTHER PUBLICATIONS

Office Action dated Apr. 23, 2014 in Korean Application No. 10-2013-0011820.

* cited by examiner

*Primary Examiner* — Samir Abdosh
(74) *Attorney, Agent, or Firm* — Saliwanchik, Lloyd & Eisenschenk

(57) ABSTRACT

A dot sight having power saving functions and a control method thereof are disclosed. The dot sight, which includes a battery, a dot visual chart generator, and a reflector disposed therein and which is mounted on a portable gun, includes a controller which selects an operation mode in which power of the dot visual chart generator is turned on and a power saving mode in which the power of the dot visual chart generator is turned off, and a timer which measures a time from when the operation mode is started, and the controller converts a mode into the power saving mode after a predetermined time using a time measured by the timer. Accordingly, if the dot sight is not used in the operation mode, the dot sight automatically converts the operation mode into the power saving mode, and, if a movement is sensed in the power saving mode, converts the power saving mode into the operation mode, so that battery utilization efficiency can be improved. Also, if a movement is sensed by a vibration sensor when a user grips a gun or aims at a target, the power saving mode is released and thus power saving functions are achieved without any inconvenience.

12 Claims, 6 Drawing Sheets

DOT SIGHT DEVICE HAVING POWER SAVING FUNCTIONS, THE CONTROL METHOD THEREOF

CROSS-REFERENCE TO RELATED APPLICATIONS

This application claims the benefit under 35 U.S.C. §119 of Korean Patent Application Nos. 10-2012-0012841, filed Feb. 8, 2012 and 10-2013-0011820, filed Feb. 1, 2013, which are hereby incorporated by reference in their entirety.

BACKGROUND

1. Field of the Invention

The present invention relates to a dot sight having power saving functions and a control method thereof, and more particularly, to a dot sight having power saving functions, which can improve battery utilization efficiency, and a control method thereof.

2. Description of the Related Art

Characteristics of rifles depend on how rapidly the rifle can fire an aimed shot (speed) and how accurately the aimed shot hits the target (accuracy), and are directly related to aiming of the rifle. In general, the aiming of the rifle is achieved by aligning lines of a rear sight and a front sight. The aiming achieved by aligning the lines of the front sight, which is disposed at an end of a gun barrel, and the rear sight, which is disposed on a top of a main body of a gun, enables accurate firing according to skill of a user who uses the gun. However, even minor vibration or shaking makes it difficult to align the line of sight, and aligning the line of sight is unfavorable for rapid aiming which is required at a short distance or in an emergent situation. That is, such an aiming and firing method requires complicated processes such as finding and identifying a target, aligning a line of sight, and aiming, and also requires much time. Also, the front sight and the rear sight are very small and thus may respond to minor vibration very sensitively when the user aligns the line of sight. Also, if a shooter is too meticulous in aligning the line of sight, the shooter's eye focuses on the front sight and the rear sight rather than the target or front situation and thus the shooter's view field becomes narrow.

An optical sight has been suggested for the purpose of solving the difficulty in aligning the line of sight and improving accuracy. However, since the optical sight uses a telephoto lens, it may respond to minor vibration sensitively if a magnification increases. Therefore, it is impossible to achieve rapid aiming.

In order to solve the above problems, the optical sight employs a no-magnification (low magnification) lens, or a dot sight, which removes a complicated line of sight and simply uses an aiming dot, has been suggested.

The optical dot sight is characterized by a simple structure and a rapid aiming ability, and is useful when it is used in an emergent situation or at a short distance, which requires a rapid reaction. That is, much time is not required to align the line of sight and aiming is achieved simply by moving a light dot to a target rapidly. Also, a view field can be efficiently guaranteed. Therefore, the time required to aim can be reduced and things that obstruct the view field and checking of a situation due to the aiming can be reduced to the maximum.

As shown in FIG. 1, the optical dot sight is comprised of an inner body tube adjusting knob 7 which is disposed on a top of a sight housing 2 of a cylindrical shape, a fixing grill 26 which is removably connected to an upper end of a rifle rear sight assembly on a lower portion of the sight housing 2 in a rail way, a protective window 10 which is disposed on a front end of the housing, a dot visual chart generator 8 which is disposed on a predetermined location of an upper end in the housing 2, and a reflector 9 which has a specific bending modulus and is disposed behind the protective window 10 in the housing 2.

The reflector 9 allows an observer's (user's) visual line to pass through the front end of the dot sight 1, while reflecting a virtual image of a dot visual chart of the dot visual chart generator 8 on the rear end. The observer (user) fires the gun if the virtual image of the dot visual chart of the dot visual chart generator 8 is consistent with a target, so that aiming can be easily achieved.

However, if a power switch is turned on, power of the dot visual chart generator is kept being turned on regardless of whether the dot sight is used or not. If the user does not turn off the power switch and leaves it turned on, there is a problem that a battery is discharged.

In particular, if the power switch is turned on, the lifespan of the battery may be reduced. Also, if the power switch is turned off in order to save the battery, it is difficult to rapidly respond to an emergent situation since the user should turn on the power switch prior to aiming at a target.

BRIEF SUMMARY

Accordingly, the present invention is conceived to solve the forgoing problems, and one or more exemplary embodiments provide a dot sight having power saving functions, which, if the dot sight is not used in an operation mode, automatically converts the operation mode into a power saving mode, and, if a movement is sensed in the power saving mode, converts the power saving mode into the operation mode, so that battery utilization efficiency can be improved, and a control method thereof.

One or more exemplary embodiments also provide a dot sight having power saving functions, which, if vibration is sensed in an operation mode, inhibits the operation mode from being converted into a power saving mode by initializing a value of a timer, and a control method thereof.

One or more exemplary embodiments also provide a dot sight having power saving functions, which measures a remaining charge of a battery, and, if a measurement value does not exceed a predetermined value, flashes a dot visual chart generator multiple times, thereby informing a user that the battery should be replaced, and thus being inhibited from being inoperative due to exhaustion of power of the battery in an emergent situation, and a control method thereof.

One or more exemplary embodiments also provide a dot sight having power saving functions, which adjusts brightness of a dot visual chart generator according ambient illumination using a measurement value of an illuminance sensor, and also, manually adjusts brightness of the dot visual chart generator by means of a manual adjuster, so that battery utilization efficiency can be improved, and a control method thereof.

According to an aspect of an exemplary embodiment, there is provided a dot sight which includes a battery, a dot visual chart generator, and a reflector disposed therein and which is mounted on a portable gun, the dot sight including: a controller which selects an operation mode in which power of the dot visual chart generator is turned on and a power saving mode in which the power of the dot visual chart generator is turned off; and a timer which measures a time from when the operation mode is started, wherein the controller converts a mode into the power saving mode after a predetermined time using a time measured by the timer.

The dot sight may further include a vibration sensor which is disposed in the dot sight and senses a movement of the gun, and, if a movement sensing signal of the gun is provided by the vibration sensor in the power saving mode, the controller may convert the power saving mode into the operation mode.

If the power saving mode is converted into the operation mode, the controller may initialize a value of the timer.

If a movement sensing signal is provided by the vibration sensor in the operation mode, the controller may initialize the value of the timer.

The vibration sensor may be comprised of at least one of an acceleration sensor, an angular velocity sensor (gyro sensor), a geomagnetic sensor, and a hall sensor.

The dot sight may further include a power switch which supplies power of the battery to the dot visual chart generator or shuts off the power supply to the dot visual chart generator, and, if the power switch is turned on, the controller may measure a remaining charge of the battery, and, if the measured remaining charge of the battery is less than a predetermined value, the controller may flash the dot visual chart generator multiple times and then perform the operation mode.

The dot sight may further include an illuminance sensor which measures ambient brightness, and the controller may adjust brightness of the dot visual chart generator in proportion to a measurement value of the illuminance sensor.

The dot sight may further include a manual adjuster which adjusts brightness of the dot visual chart generator by means of user's manipulation.

According to an aspect of another exemplary embodiment, there is provided a control method of a dot sight having power saving functions, the control method including: turning on a power switch which supplies power to the dot sight; performing an operation mode by turning on power of a dot visual chart generator of the dot sight; initializing a value of a timer; turning on the timer; comparing a value of the timer which is measured from when the operation mode is started with a predetermined value; if the value of the timer is greater than or equal to the predetermined value, performing a power saving mode by turning off the power of the dot visual chart generator of the dot sight; and performing a first movement sensing operation, which senses a movement of a gun through a vibration sensor in the power saving mode, and, if the movement of the gun is sensed, goes to the operation of performing the operation mode.

The control method may further include, if the value of the timer does not exceed the predetermined value in the operation of comparing the value of the timer, performing a second movement sensing operation, which senses a movement of the gun through the vibration sensor in the operation mode, and, if the movement of the gun is sensed, goes to the operation of initializing the timer, and, if the movement of the gun is not sensed, goes to the operation of comparing the value of the timer.

The control method may further include: after turning on the power switch, comparing a remaining charge of the battery with a predetermined value; and if the remaining charge of the battery is less than the predetermined value, flashing the dot visual chart generator multiple times.

According to an aspect of still another exemplary embodiment, there is provided a control method of a dot sight having power saving functions, the control method including: performing a power saving mode by turning off power of a dot visual chart generator of the dot sight; checking a power switch, which, if the power switch is tuned off as a result of checking a state of the power switch, returns to the previous operation of performing the power saving mode, and, if the power switch is turned on, goes to an operation of performing an operation mode; performing the operation mode by turning on the power of the dot visual chart generator; initializing a value of a timer; turning on the timer; a timer sub-routine which compares the value of the timer with a predetermined value, and, if the value of the timer is greater than or equal to the predetermined value, goes to the operation of performing the power saving mode; and a vibration sensing sub-routine which senses a movement of a gun through a vibration sensor, if a movement is sensed in the operation mode, initializes the value of the timer, and, if a movement is sensed in the power saving mode, goes to the operation of performing the operation mode.

The control method may further include: after performing the operation mode, comparing a remaining charge of a battery with a predetermined value; and if the remaining charge of the battery is less than the predetermined value, flashing the dot visual chart generator multiple times.

The control method may further include, after turning on the timer, automatically adjusting brightness of the dot visual chart generator by comparing a measurement rate of an illuminance sensor and a duty rate of the dot visual chart generator, and by increasing or decreasing the duty rate of the dot visual chart generator in proportion to the measurement rate of the illuminance sensor.

The control method may further include, after automatically adjusting the brightness of the dot visual chart generator, manually adjusting the brightness of the dot visual chart generator by increasing or decreasing the duty rate of the dot visual chart generator according to input of a key of a manual adjuster.

According to the present invention, a dot sight having power saving functions, which, if the dot sight is not used in an operation mode, automatically converts the operation mode into a power saving mode, and, if a movement is sensed in the power saving mode, converts the power saving mode into the operation mode, so that battery utilization efficiency can be improved, and a control method thereof are provided.

Also, a dot sight having power saving functions, which, if vibration is sensed in an operation mode, inhibits the operation mode from being converted into a power saving mode by initializing a value of a timer, and a control method thereof are provided.

Also, a dot sight having power saving functions, which measures a remaining charge of a battery, and, if a measurement value does not exceed a predetermined value, flashes a dot visual chart generator multiple times, thereby informing a user that the battery should be replaced, and thus being inhibited from being inoperative due to exhaustion of power of the battery in an emergent situation, and a control method thereof are provided.

Also, a dot sight having power saving functions, which adjusts brightness of a dot visual chart generator according ambient illumination using a measurement value of an illuminance sensor, and also, manually adjusts brightness of the dot visual chart generator by means of a manual adjuster, so that battery utilization efficiency can be improved, and a control method thereof are provided.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION

Figure 1:
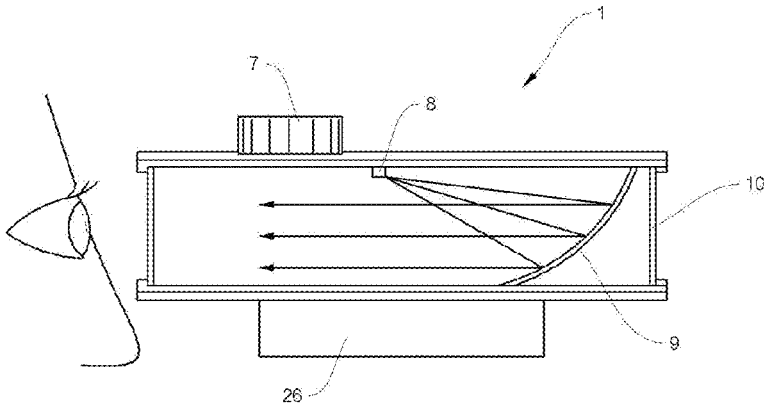
FIG. 1 is a cross section view illustrating a related-art optical dot sight.

Hereinafter, exemplary embodiments will be described in greater detail with reference to the accompanying drawings. The same elements will be explained in a first exemplary embodiment using same reference numerals, and elements different from those of the first exemplary embodiment will be explained in the other exemplary embodiments.

Hereinafter, a dot sight having power saving functions according to a first exemplary embodiment of the present invention will be explained with reference to the accompanying drawings.

Figure 2:
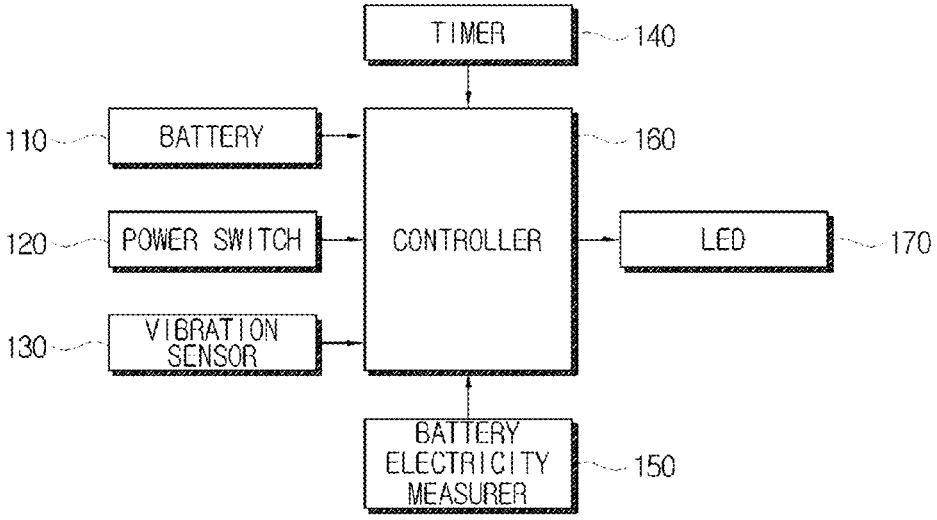
FIG. 2 is a schematic block diagram illustrating a dot sight having power saving functions according to a first exemplary embodiment of the present invention.

FIG. 2 is a schematic block diagram illustrating a dot sight having power saving functions of the present invention.

As shown in FIG. 2, a dot sight having power saving functions of the present invention includes a battery 110 which is removably disposed in the dot sight and provides power, a power switch 120 which connects or shut off power of the battery 110, a vibration sensor 130 which senses a movement of a gun on which the dot sight is disposed, a timer 140 which measures a time, a battery electricity measurer 150 which measures an output voltage of the battery 110, a dot visual chart generator 170 which receives power from the battery 110 and emits light, thereby generating an aiming dot, and a controller 160 which sets an operation mode in which power of the dot visual chart generator 170 is turned on and a power saving mode in which power of the dot visual chart generator 170 is turned off, using measurement values which are obtained from the vibration sensor 130, the timer 140, and the battery electricity measurer 150.

The dot visual chart generator 170 may include a light emitting means (a light emitting diode (LED) or a laser diode (LD)), and a light transmission reticle which is disposed at a leading end of the light emitting means and allows light projected from the light emitting means to pass therethrough, thereby forming a dot visual chart, or may be configured to form a dot visual chart by activating pixels like an organic light emitting diode (OLED), a liquid crystal display (LCD), a liquid crystal on silicon (LCOS), or a plasma display panel (PDP). The light transmission reticle is rotatable such that a type of a dot visual chart can be selected according to a type or a distance of a target. If the dot visual chart generator is comprised of the OLED, the LCD, the LCOS, and the PDP, the dot visual chart generator may minutely adjust a shape or a location of a dot by activating pixels at desired locations.

If a time measured by the timer 140 exceeds a predetermined time, the controller 160 converts a current mode into the power saving mode, and, if a sensing signal is obtained from the vibration sensor 130 in the power saving mode, the controller 160 converts the power saving mode into the operation mode and initializes the value of the timer 140.

Also, if the time measured by the timer 140 does not exceed the predetermined time in the operation mode and if a sensing signal is obtained from the vibration sensor 130, the controller 160 initializes the value of the timer 140.

Also, if the power switch 120 is turned on and a remaining charge of the battery 110, which is obtained by the battery electricity measurer 150, is less than a predetermined value, the controller 160 flashes the dot visual chart generator 170 multiple times and informs a user that the battery 110 should be charged or replaced.

The vibration sensor 130 senses a movement of the gun and generates a movement sensing signal, and may include an acceleration sensor from among an acceleration sensor, an angular velocity sensor, a geomagnetic sensor, and a hall sensor, or a plurality of sensors including an acceleration sensor. The acceleration sensor calculates acceleration information corresponding to an axis such as a 2-axis or a 3-axis or a specific direction according to the movement of the gun, and an output value of the acceleration sensor may include an inclination and acceleration of a movement.

The operation mode in the present exemplary embodiment refers to a state in which enough power to turn on the power of the dot visual chart generator 170 embedded in the dot sight is supplied, and the power saving mode refers to a state in which power for driving only the vibration sensor 130 and the controller 160 is supplied. More specifically, the operation mode refers to a state in which the power of the battery 110 is supplied not only to the dot visual chart generator 170, but also to the vibration sensor 130, the timer 140, the battery electricity measurer 150, and the controller 160, and the power saving mode refers to a state in which power is supplied only to the vibration sensor 130 and the controller 160, which are used to sense a movement of the gun and set the operation mode.

In addition, the power switch 120 is to supply the power of the battery 110 to the dot visual chart generator 170, and may employ a rotary type switch.

A manual adjuster 190 may be provided in the form of a button type and may adjust brightness of the dot visual chart generator 170 according to a number of times that the button is pressed.

Hereinafter, a control method of the dot sight having the power saving functions according to the first exemplary embodiment as described above will be explained.

Figure 3:
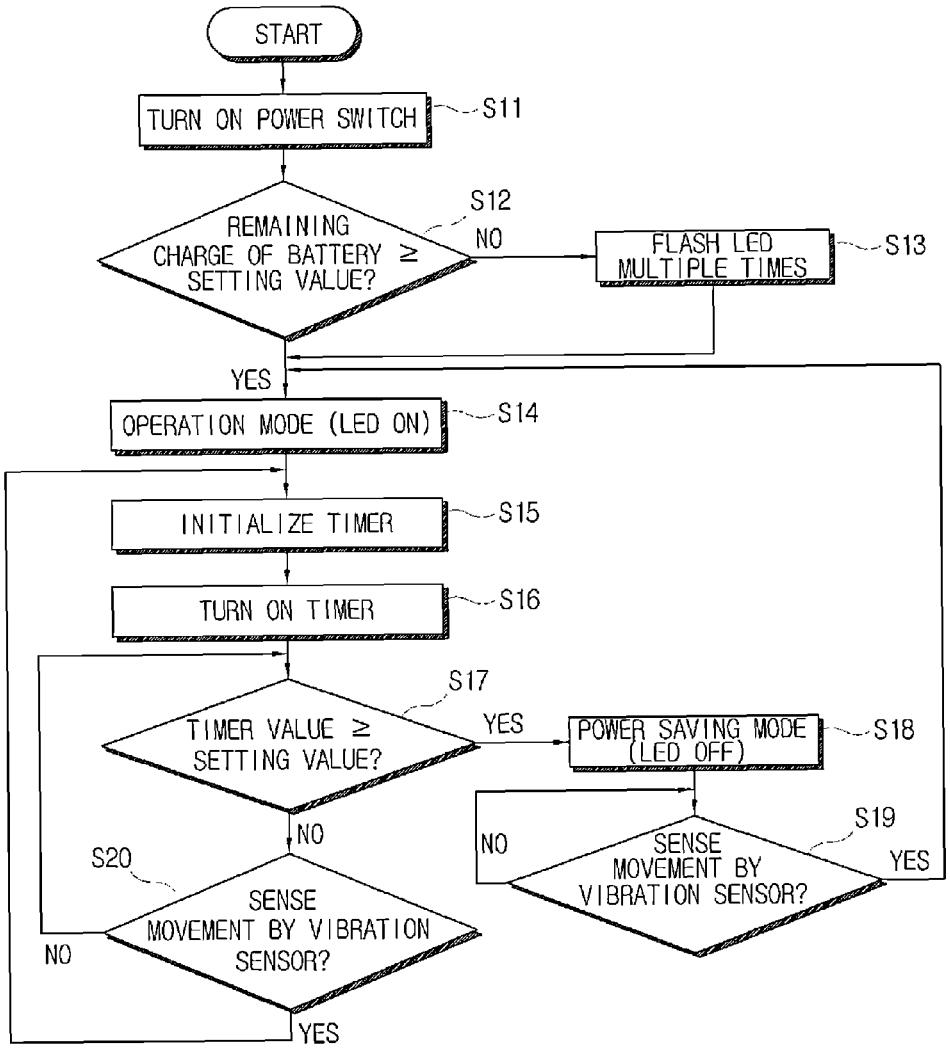
FIG. 3 is a flowchart illustrating a control method of the dot sight having the power saving functions according to the first exemplary embodiment of the present invention.

FIG. 3 is a flowchart illustrating a control method of the dot sight having the power saving functions according to the first exemplary embodiment of the present invention.

As shown in FIG. 3, if the power switch 120 is turned on in order to supply power to the dot sight (S11), the controller 160 performs a battery measuring operation (S12) by measuring a remaining charge of the battery 110 using the battery electricity measurer 150 and comparing the measured remaining charge with a predetermined value.

If the remaining charge of the battery 110 is less than the predetermined value as a result of performing the battery measuring operation (S12), the controller 160 flashes the dot visual chart generator 170 multiple times and informs the user of a battery replacement time (S13), and then performs an operation mode by turning on the power of the dot visual chart generator 170 (S14). If the remaining charge of the battery 110 is greater than or equal to the predetermined value, the controller 160 directly performs the operation mode by turning on the power of the dot visual chart generator 170 (S14). Accordingly, the dot sight can be inhibited from being inoperative in an emergent situation due to exhaustion of power of the battery 110.

After performing the operation mode (S14), the controller 160 initializes a value of the timer 140 (S15), turns on the timer 140 (S16), and measures a time from when entering the operation mode.

The controller 160 compares a value of the timer 140, which is measured from when the operation mode is started, with a predetermined value (S17). If the value of the timer 140 exceeds the predetermined value, the controller 160 performs a power saving mode (S18) by shutting off the power supplied to the dot visual chart generator 170 of the dot sight and turning off the power of the dot visual chart generator 170. On the other hand, if the value of the timer 140 does not exceed the predetermined value, the controller 160 performs a second movement sensing operation (S20) by sensing a movement of the gun using the vibration sensor 130 in the operation mode. Specifically, if a movement is sensed, the controller 160 returns to the operation of initializing the timer 140 (S15), and, if a movement is not sensed, the controller 160 returns to the operation of comparing the value of the timer 140 (S17).

That is, the vibration sensor 130 continuously senses vibration in the operation mode, and, if vibration is sensed, the value of the timer 140 is initialized so that the mode of the dot sight can be inhibited from being converted into the power saving mode while the dot sight is in use. Accordingly, the gun can be inhibited from entering the power saving mode while it is in use in an emergent situation because the value of the timer 140 exceeds the predetermined value.

Also, the value of the timer 140 is set to increase only if a movement is not sensed by the vibration sensor 130 in the operation mode, and, if the value of the timer 140 exceeds the predetermined value, that is, only if the gun stays in a stationary state for more than a predetermined time, the operation mode is converted into the power saving mode. Therefore, unnecessary repetitive conversion between the power saving mode and the operation mode can be inhibited.

On the other hand, when entering the power saving mode, the controller 160 performs a first movement sensing operation (S19). Specifically, the controller 160 continuously senses a movement of the gun using the vibration sensor 130, and, if a movement of the gun is sensed, the controller 160 returns to the operation mode (S14).

That is, if a movement is sensed by the vibration sensor 130 in the power saving mode, the power saving mode is directly converted into the operation mode. Therefore, an operation for manipulating a separate switch to release the power saving mode is not required, and, simply by griping the gun and taking aim, a movement is sensed by the vibration sensor 130 and the power saving mode is released. Thus, the user can achieve the power saving functions without any inconvenience.

Hereinafter, a dot sight having power saving functions according to a second exemplary embodiment of the present invention will be explained with reference to the accompanying drawings.

Figure 4:
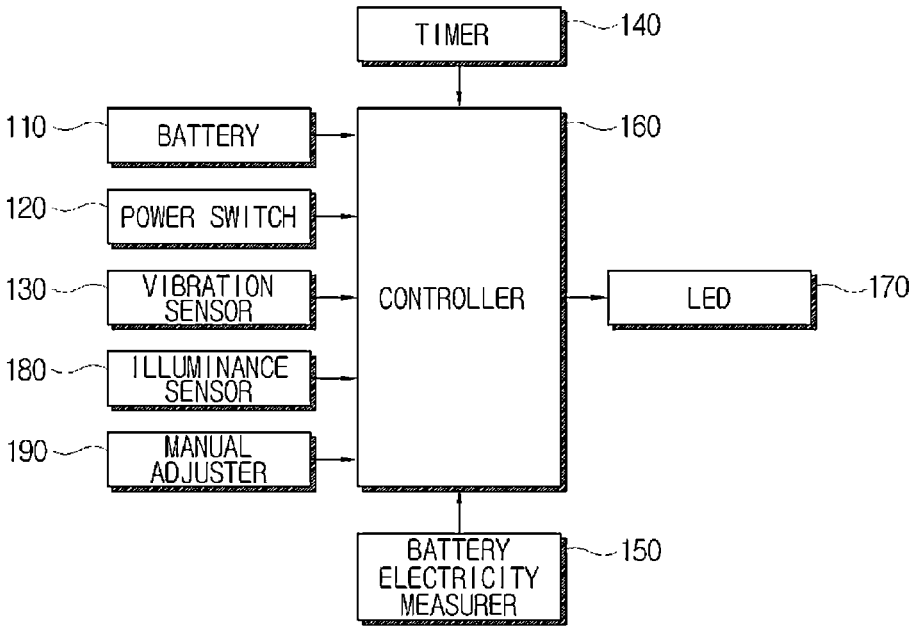
FIG. 4 is a schematic block diagram illustrating a dot sight having power saving functions according to a second exemplary embodiment of the present invention.

FIG. 4 is a schematic block diagram illustrating a dot sight having power saving functions according to a second exemplary embodiment of the present invention.

As shown in FIG. 4, the dot sight having the power saving functions according to the second exemplary embodiment of the present invention further includes an illuminance sensor 180 which measures ambient brightness of the gun on which the dot sight is installed, and a manual adjuster 190 which adjusts brightness of the dot visual chart generator 170 according to input of the user. The dot sight of the second exemplary embodiment differs from that of the first exemplary embodiment in that brightness of the dot visual chart generator is automatically or manually adjusted.

The controller 160 may automatically adjust brightness of the dot visual chart generator 170 using a measurement value which is measured by the illuminance sensor 180, or may automatically adjust brightness of the dot visual chart generator 170 using an input value which is input through the manual adjuster 190.

The manual adjuster 190 may employ a rotary type or a button type and may be configured to input a necessary control signal. In the present exemplary embodiment, the button type is employed and brightness of the dot visual chart generator 170 is adjusted according to a number of times that the button is pressed.

Other elements except for the illuminance sensor 180 and the manual adjuster 190 may be the same as those of the first exemplary embodiment and thus a detailed explanation thereof is omitted.

Hereinafter, a control method using the dot sight having the power saving functions configured above according to the second exemplary embodiment of the present invention will be explained.

Figure 5:
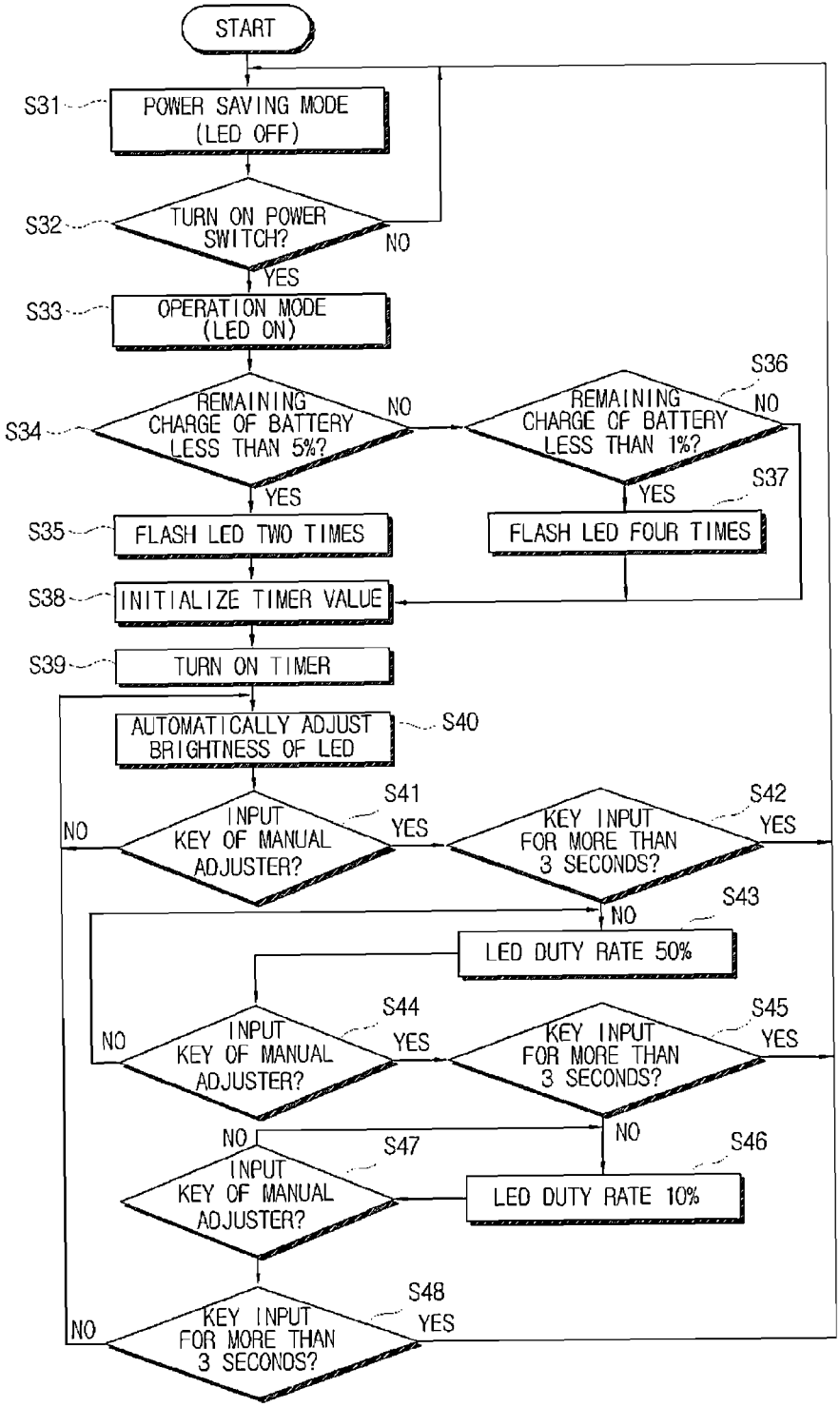
FIG. 5 is a flowchart illustrating a control method of the dot sight having the power saving functions according to the second exemplary embodiment of the present invention.
Figure 6:
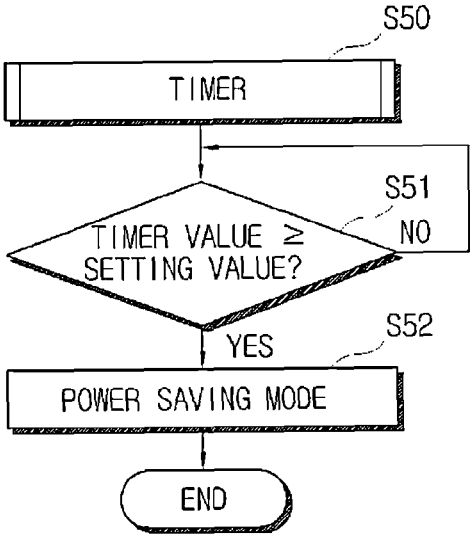
FIG. 6 is a flowchart illustrating a timer sub-routine of the control method of the dot sight having the power saving functions according to the second exemplary embodiment of the present invention.
Figure 7:
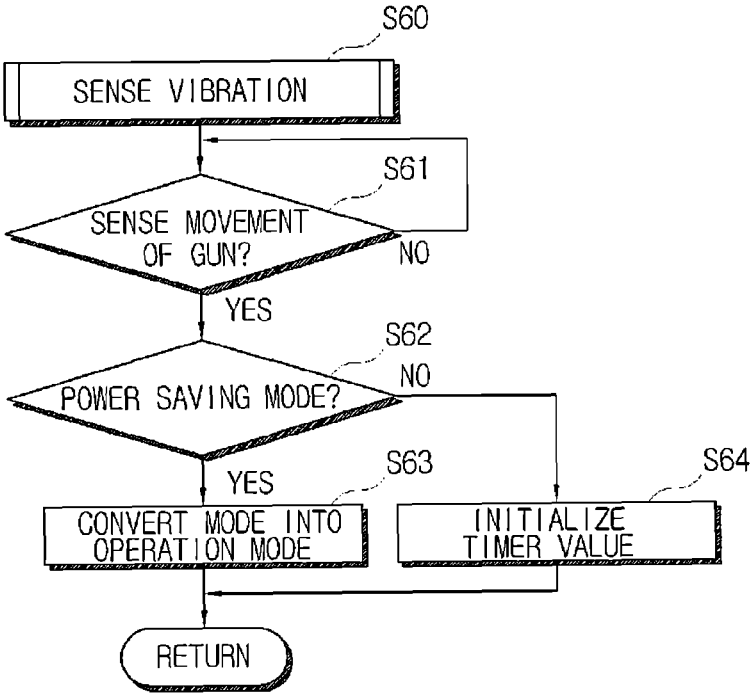
FIG. 7 is a flowchart illustrating a vibration sensing sub-routine of the control method of the dot sight having the power saving functions according to the second exemplary embodiment of the present invention.
Figure 8:
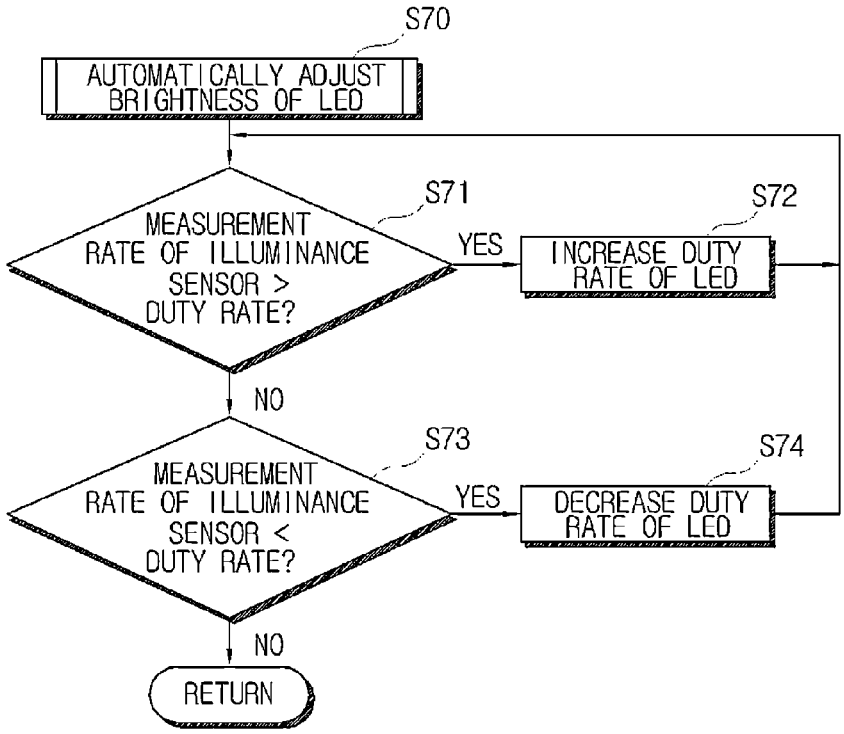
FIG. 8 is a flowchart illustrating a sub-routine for automatically adjusting brightness of a dot visual chart generator of the control method of the dot sight having the power saving functions according to the second exemplary embodiments of the present invention.

FIG. 5 is a flowchart illustrating a control method of the dot sight having the power saving functions according to the second exemplary embodiment of the present invention, FIG. 6 is a flowchart illustrating a timer sub-routine of the control method of the dot sight having the power saving functions according to the second exemplary embodiment of the present invention, FIG. 7 is a flowchart illustrating a vibration sensing sub-routine of the control method of the dot sight having the power saving functions according to the second exemplary embodiment of the present invention, and FIG. 8 is a flowchart illustrating a sub-routine for automatically adjusting brightness of the dot visual chart generator in the control method of the dot sight having the power saving functions according to the second exemplary embodiment of the present invention.

As shown in FIG. 5, the control method of the dot sight having the power saving functions according to the second exemplary embodiment includes: an operation of performing a power saving mode (S31), which turns off power of the dot visual chart generator 170 (LED) of the dot sight; a power switch 120 checking operation (S32) which, if the power switch 120 is turned off, returns to the previous power saving mode operation (S31), and, if the power switch 120 is turned on, goes to a next operation; an operation of performing an operation mode (S33), which turns on the power switch 120 to supply power to the dot sight and turns on the power of the dot visual chart generator 170 (LED) of the dot sight; an operation of measuring a remaining charge of the battery 110; a timer initializing operation (S38) of initializing a value of the timer 140; an operation (S39) of turning on the timer 140; an operation (S40) of automatically adjusting brightness of the dot visual chart generator 170 by comparing a measurement rate of the illuminance sensor 180 and a duty rate of the dot visual chart generator 170 (LED PWM DUTY RATE) and increasing or decreasing the duty rate of the dot visual chart generator 170 in proportion to the measurement rate of the illuminance sensor 180; and an operation of manually adjusting brightness of the dot visual chart generator 170 by increasing or decreasing the duty rate of the dot visual chart generator 170 according to a number of times that a key of the manual adjuster 190 is input.

The operation of measuring the remaining charge of the battery 110 is divided into an operation of comparing the remaining charge of the battery 110 with a predetermined value, and an operation of flashing the dot visual chart generator 170 multiple times if the remaining charge of the battery 110 is less than the predetermined value. More specifically, if the remaining charge of the battery 110 is less than 5% (S34), the dot visual chart generator 170 is flashed two times (S35), and, if the remaining charge of the battery 110 is less than 1% (S36), the dot visual chart generator 170 is flashed four times (S37), so that the remaining charge of the battery 110 is displayed for the user. If the remaining charge of the battery 110 is greater than or equal to 5%, the next operation is performed directly.

In the operation of manually adjusting brightness of the dot visual chart generator 170, if the key of the manual adjuster 190 is input one time, the duty rate of the dot visual chart generator 170 is set to 50%, and, if the key of the manual adjuster 190 is input two times, the duty rate of the dot visual chart generator 170 is set to 10%. If the key of the manual adjuster 190 is input three times, the control method goes back to the operation of automatically adjusting brightness of the dot visual chart generator 170 (S40). Also, if the key of the manual adjuster 190 is input for more than 3 seconds, the control method goes back to the operation of performing the power saving mode (S31).

In the operation of manually adjusting brightness of the dot visual chart generator 170, it is checked whether a first key of the manual adjuster 190 is input or not (S41). If the first key is not input, the control method goes back to the operation of automatically adjusting brightness of the dot visual chart generator 170 (S40). If the first key is input, it is determined whether the key is input for more than 3 seconds (S42). If the key is input for more than 3 seconds, the control method goes back to the operation of performing the power saving mode (S31), and, if the key is input for less than 3 seconds, the duty rate of the dot visual chart generator 170 is set to 50% (S43).

It is checked whether a second key of the manual adjuster 190 is input or not (S44). If the second key is not input, the control method goes back to the operation S42 and maintains the duty rate of the dot visual chart generator 170 of 50%. If the second key is input, it is determined that the key is input for more than 3 seconds (S45). If the key is input for more than 3 seconds, the control method goes back to the operation of performing the power saving mode (S31), and, if the key is input for less than 3 seconds, the duty rate of the dot visual chart generator 170 is set to 10% (S46).

It is checked whether a third key of the manual adjuster 190 is input or not (S47). If the third key is not input, the control method goes back to the operation S46 and maintains the duty rate of the dot visual chart generator 170 of 10%. If the third key is input, it is determined whether the third key is input for more than 3 seconds (S48). If the third key is input for more than 3 seconds, the control method goes back to the operation of performing the power saving mode (S31), and, if the third key is input for less than 3 seconds, the control method goes back to the operation and automatically adjusts brightness of the dot visual chart generator 170 using the illuminance sensor.

The control method of the second exemplary embodiment of the present invention includes a timer sub-routine (S50), a vibration sensing sub-routine (S60), and a sub-routine (S70) for automatically adjusting brightness of the dot visual chart generator 170, besides the above-described main routine.

As shown in FIG. 6, the timer sub-routine (S50) compares a value of the timer 140 with a predetermined value (S51), and converts a mode into the power saving mode if the value of the timer 140 is greater than or equal to the predetermined value (S52).

As shown in FIG. 7, the vibration sensing sub-routine (S60) senses a movement of the gun through the vibration sensor 130 (S61), determines whether the movement is sensed in the power saving mode or not (S62), goes to the operation of performing the operation mode if the movement is sensed in the power saving mode (S63), initializes the value of the timer if the movement is sensed in the operation mode, and then, returns to the next operation of the operation in which a call is generated.

As shown in FIG. 8, the sub-routine (S70) for automatically adjusting brightness of the dot chart generator 170 compares a measurement rate of the illuminance sensor 180 (measurement value of the illuminance sensor/maximum measurement value*100) and a duty rate of the dot visual chart generator 170 (a ratio of an ON-period of time to the whole period of time), and increases or decreases the duty rate of the dot visual chart generator 170 in proportion to the measurement rate of the illuminance sensor 180. Specifically, the sub-routine S70 compares the measurement rate of the illuminance sensor 180 and the duty rate of the dot visual chart generator 170, if the measurement rate of the illuminance sensor 180 is higher than the duty rate of the dot visual chart generator 170 (S71), increases the duty rate of the dot visual chart generator 170 as much as the measurement rate of the illuminance sensor 180, and, if the measurement rate of the illuminance sensor 180 is lower than the duty rate of the dot visual chart generator 170 (S73), decreases the duty rate of the dot visual chart generator 170 as much as the measurement rate of the illuminance sensor 180, such that the brightness of the dot visual chart generator 170 is automatically adjusted in proportion to the measurement value of the illuminance sensor 180. Then, the sub-routine returns to the next operation of the operation in which a call is generated.

If the value of the timer 140 exceeds the predetermined value while the main routine is performed, the timer sub-routine (S50) is called, and, if vibration is sensed by the vibration sensor 130, the vibration sensing sub-routine (S60) is called and performed.

According to the exemplary embodiments of the present invention as described above, the brightness of the dot visual chart generator 170 can be adjusted according ambient illumination using the measurement value of the illuminance sensor 180, and also, the brightness of the dot visual chart generator 170 can be manually adjusted by the manual adjuster 190. Therefore, battery utilization efficiency can be improved.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A dot sight which comprises a battery, a dot visual chart generator, and a reflector disposed therein and which is mounted on a portable gun, the dot sight comprising:

a controller which selects an operation mode in which power of the dot visual chart generator is turned on and a power saving mode in which the power of the dot visual chart generator is turned off;

a timer which measures a time from when the operation mode is started, wherein the controller converts a mode into the power saving mode after a predetermined time using a time measured by the timer; and a vibration sensor which is disposed in the dot sight and senses a movement of the gun;

wherein, if a movement sensing signal of the gun is provided by the vibration sensor in the power saving mode, the controller converts the power saving mode into the operation mode;

wherein, if the power saving mode is converted into the operation mode the controller initializes a value of the timer; and wherein, if the movement sensing signal is provided by the vibration sensor in the operation mode, the controller initializes the value of the timer.

2. The dot sight according to claim 1, wherein the vibration sensor is comprised of at least one of an acceleration sensor, an angular velocity sensor, a geomagnetic sensor, and a hall sensor.

3. A dot sight which comprises a battery, a dot visual chart generator, and a reflector disposed therein and which is mounted on a portable gun, the dot sight comprising:

a controller which selects an operation mode in which power of the dot visual chart generator is turned on and a power saving mode in which the power of the dot visual chart generator is turned off;

a timer which measures a time from when the operation mode is started, wherein the controller converts a mode into the power saving mode after a predetermined time using a time measured by the timer; and a vibration sensor which is disposed in the dot sight and senses a movement of the gun;

wherein, if a movement sensing signal of the gun is provided by the vibration sensor in the power saving mode, the controller converts the power saving mode into the operation mode;

wherein, if the power saving mode is converted into the operation mode, the controller initializes a value of the timer;

wherein the dot sight further comprises a power switch which supplies power of the battery to the dot visual chart generator or shuts off the power supply to the dot visual chart generator; and wherein, if the power switch is turned on, the controller measures a remaining charge of the battery, and, if the measured remaining charge of the battery is less than a predetermined value, the controller flashes the dot visual chart generator multiple times and then performs the operation mode.

4. A dot sight which comprises a battery, a dot visual chart generator, and a reflector disposed therein and which is mounted on a portable gun, the dot sight comprising:

a controller which selects an operation mode in which power of the dot visual chart generator is turned on and a power saving mode in which the power of the dot visual chart generator is turned off;

a timer which measures a time from when the operation mode is started, wherein the controller converts a mode into the power saving mode after a predetermined time using a time measured by the timer; and a vibration sensor which is disposed in the dot sight and senses a movement of the gun;

wherein, if a movement sensing signal of the gun is provided by the vibration sensor in the power saving mode, the controller converts the power saving mode into the operation mode;

wherein, if the power saving mode is converted into the operation mode, the controller initializes a value of the timer;

wherein the dot sight further comprises an illuminance sensor which measures ambient brightness; and wherein the controller adjusts brightness of the dot visual chart generator in proportion to a measurement value of the illuminance sensor.

5. The dot sight according to claim 4, further comprising a manual adjuster which adjusts brightness of the dot visual chart generator by means of user's manipulation.

6. A control method of a dot sight having power saving functions, the control method comprising:

turning on a power switch which supplies power to the dot sight;

performing an operation mode by turning on power of a dot visual chart generator of the dot sight;

initializing a value of a timer;

turning on the timer;

comparing a value of the timer which is measured from when the operation mode is started with a predetermined value;

if the value of the timer is greater than or equal to the predetermined value, performing a power saving mode by turning off the power of the dot visual chart generator of the dot sight; and performing a first movement sensing operation, which senses a movement of a gun through a vibration sensor in the power saving mode, and, if the movement of the gun is sensed, goes to the operation of performing the operation mode.

7. The control method according to claim 6, further comprising, if the value of the timer does not exceed the predetermined value in the operation of comparing the value of the timer, performing a second movement sensing operation, which senses a movement of the gun through the vibration sensor in the operation mode, and, if the movement of the gun is sensed, goes to the operation of initializing the timer, and, if the movement of the gun is not sensed, goes to the operation of comparing the value of the timer.

8. The control method according to claim 7, further comprising:

after turning on the power switch, comparing a remaining charge of the battery with a predetermined value; and if the remaining charge of the battery is less than the predetermined value, flashing the dot visual chart generator multiple times.

9. A control method of a dot sight having power saving functions, the control method comprising:

performing a power saving mode by turning off power of a dot visual chart generator of the dot sight;

checking a power switch, which, if the power switch is tuned off as a result of checking a state of the power switch, returns to the previous operation of performing the power saving mode, and, if the power switch is turned on, goes to an operation of performing an operation mode;

performing the operation mode by turning on the power of the dot visual chart generator;

initializing a value of a timer;

turning on the timer;

a timer sub-routine which compares the value of the timer with a predetermined value, and, if the value of the timer is greater than or equal to the predetermined value, goes to the operation of performing the power saving mode; and a vibration sensing sub-routine which senses a movement of a gun through a vibration sensor, if a movement is sensed in the operation mode, initializes the value of the timer, and, if a movement is sensed in the power saving mode, goes to the operation of performing the operation mode.

10. The control method according to claim 9, further comprising:

after performing the operation mode, comparing a remaining charge of a battery with a predetermined value; and if the remaining charge of the battery is less than the predetermined value, flashing the dot visual chart generator multiple times.

11. The control method according to claim 10, further comprising, after turning on the timer, automatically adjusting brightness of the dot visual chart generator by comparing a measurement rate of an illuminance sensor and a duty rate of the dot visual chart generator, and by increasing or decreasing the duty rate of the dot visual chart generator in proportion to the measurement rate of the illuminance sensor.

12. The control method according to claim 11, further comprising, after automatically adjusting the brightness of the dot visual chart generator, manually adjusting the brightness of the dot visual chart generator by increasing or decreasing the duty rate of the dot visual chart generator according to input of a key of a manual adjuster.

* * * * *